US006281628B1

(12) United States Patent
Choi et al.

(10) Patent No.: US 6,281,628 B1
(45) Date of Patent: Aug. 28, 2001

(54) PLASMA DISPLAY PANEL AND A DRIVING METHOD THEREOF

(75) Inventors: Tae-Wan Choi; Seong-Ho Kang, both of Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/247,866

(22) Filed: Feb. 11, 1999

(30) Foreign Application Priority Data

Feb. 13, 1998 (KR) ..... 1998-4346
Feb. 4, 1999 (KR) ..... 1999-3653

(51) Int. Cl.[7] ..... H01J 17/49
(52) U.S. Cl. ..... 313/585; 313/586; 313/583; 313/584; 313/582
(58) Field of Search ..... 313/585, 586, 313/587, 584, 583, 582

(56) References Cited

U.S. PATENT DOCUMENTS 5,155,414 10/1992 Sano ..... 315/169.4
5,736,815 * 4/1998 Amemiya ..... 313/586

FOREIGN PATENT DOCUMENTS

63131436 A 6/1988 (JP) .
02148645 A 6/1990 (JP) .
04272634 A 9/1992 (JP) .
4280289 10/1992 (JP) .
05250992 A 9/1993 (JP) .
06044907 2/1994 (JP) .
09-160525 6/1997 (JP) .

* cited by examiner

*Primary Examiner*—Frank G. Font
*Assistant Examiner*—Roy M. Punnoose
(74) *Attorney, Agent, or Firm*—Fleshner & Kim, LLP

(57) ABSTRACT

The present invention relates to a plasma display panel in which a plurality of row electrodes are arranged to be crossed with a plurality of column electrodes in a plurality of cells, and one row electrode is concerned in the electric discharge of two adjacent cell groups and a driving method thereof. The row electrode has a transparent electrode with a plurality of projecting electrode parts which are alternately projected upward and downward with a predetermined width along the row axis and an opaque electrode formed at the lower part of the row axis of the transparent electrode. The column electrode is arranged on the column axis of the projecting electrode part and the row electrode concerns the discharge of two adjacent column-direction cell groups by the interaction with two other row electrodes adjacent in a column direction.

8 Claims, 7 Drawing Sheets

PLASMA DISPLAY PANEL AND A DRIVING METHOD THEREOF

BACKGROUND OF THE INVENTION

The present invention relates to a plasma display panel (hereinafter referred to as a "PDP") and a driving method thereof, and more particularly to a plasma display panel in which a plurality of row and column electrodes are arranged to be directly crossed from one another in a plurality of cells, and one row electrode is concerned in the electric discharge of two adjacent cell groups, thereby enhancing the brightness characteristic and embodying simple structure thereof.

A PDP is a flat panel display for displaying image sequence or still picture by using the gas discharge phenomenon. The screen is divided into a plurality of cells by row and column electrodes arranged on the upper and lower glass substrates, and images are displayed on the panel by the selective discharge generated inside of each cell.

As a representative example of a conventional PDP, FIGS. 1 to 3 illustrate a 3-electrode surface discharge alternating current(AC) PDP. FIG. 1 is a separated perspective view of the upper and lower substrates, FIG. 2 is a partial cross-sectional view of the upper substrate and FIG. 3 is a view showing the arrangement of the electrodes.

The conventional 3-electrode surface discharge AC PDP has an upper substrate 10 as a display surface of the image and a lower substrate 20 combined to the upper substrate 10 in parallel with a predetermined distance.

The upper substrate 10 has a row electrode 30 (hereinbelow may be referred to as a "scan electrode 31" and a sustain electrode 32") formed at the surface facing the lower substrate 20, for dividing cells in a column direction by pair, an insulating layer 40 formed to surround the row electrode 30, for limiting the discharge current, and a protecting layer 50 formed below the insulating layer 40, for protecting the row electrode 30.

Each of the scan electrode 31 and sustain electrode 32 has a transparent electrode 31*a*, 32*a* made of ITO(Indium-Tin Oxide) with the width of about 300 $\mu$m, and an opaque electrode 31*b*, 32*b* made of metal with the width of about 50~100 $\mu$m.

The lower substrate 20 has a barrier rib 60 for forming a discharge space by dividing the cells in a row direction, a column electrode 70 (hereinafter referred to as an "address electrode") formed to be crossed with the row electrode 30 between the barrier ribs 60, and a phosphor layer 80 formed on the surface of the barrier rib and the surface of the lower substrate in the discharge space to surround corresponding address electrode 70, for emitting a visible ray at the discharge.

The PDP structured as described above generates a visible ray by exciting the phosphor to the ultraviolet ray generated at the discharge between electrodes, and such a discharge will be described with reference to FIGS. 4 to 5.

FIGS. 4 and 5 show the driving wave forms applied to each electrode and the processing states of the wall charge of corresponding cell according to the driving wave forms.

Since it is difficult to adjust the strength of the discharge in the PDP, the grey level of a pixel is embodied by adjusting the discharge number per unit time. One picture element is composed of three discharge cells of R, G and B. In the case of 256 grey levels, if the discharge number of each cell is divided into 0~255 every frame, the brightness of 256 grey levels can be embodied according to the discharge number.

The discharges selectively occurred in each cell are composed of an address discharge for addressing a luminous picture element, a sustain discharge for sustaining the discharge of the cell and an erase discharge for stopping the sustaining of the discharge cell.

Here, the wall charge is formed on the insulating layer 40 near the scan electrode 31 and sustain electrode 32 in the discharge space by the address discharge between the address electrode 70 and the scan and sustain electrodes 31 and 32, and the wall charge is sustained by the sustain discharge generated between the scan electrode 31 and the sustain electrode 32.

If the driving wave forms shown in FIG. 4 are applied to the electrodes 31, 32, 70, the processing states of the wall charge in the sections (a) to (h) are shown as the states (a) to (h) in FIG. 5.

That is, there was no wall charge in the discharge cell before the state (a) of FIG. 5. If an address pulse Va and a write pulse Vw are applied to the address electrode 70 and the scan electrode 31 in the section (a), there occurs an address discharge between the address electrode 70 and the scan electrode 31. Then, there forms a wall charge in the cell at the section (b) after the address discharge.

In this case, most of the wall charge are formed at the scan electrode 31 and the sustain electrode 32. The write pulse Vw has a width of over 2 $\mu$s and this width corresponds to the time required in forming the wall charge.

If a sustain pulse Vs is applied to the scan electrode 31 and the sustain electrode 32 at the section (c), there occurs a sustain discharge between the scan and sustain electrodes 31 and 32. Then, after the first sustain discharge, the wall charge opposite to that at the section (b) is formed at the section (d).

In this case, the sustain voltage of the electrodes 70, 31, 32 may be lower than the difference of the write voltage between the address electrode 70 and the scan electrode 31. This is because of the wall charge formed on the insulating layer 40 and there occurs no sustain discharge at the cell having no wall charge.

At the sections (e) and (f), there occurs a sustain discharge by the sustain pulse Vs and the wall charge opposite to that at the section (d) is formed after the sustain discharge.

Hence, one sustain period is from the section (c) to the section (f), and the discharge number during one sustain period is 2.

The erase discharge occurs at the section (g) by the erase pulse Ve. The erase pulse Ve has a width of less than 1 $\mu$s and the voltage of the erase pulse is lower than that of the sustain pulse Vs. There occurs a discharge between the scan and sustain electrodes 31 and 32 by this erase pulse Ve, but the cell has no wall charge at the section (h), because there was no time to form the wall charge, and thus there occurs no discharge even though the sustain pulse Vs is applied.

Accompanied by such a discharge process, the discharge gas injected to the discharge space of corresponding cell is ionized into an electron and an ion, thus generating ultraviolet rays. The phosphor layer 80 is excited by the ultraviolet rays, to emit a visible ray. Thereafter, if the visible ray passes through between paired row electrodes 30, i.e., between the scan electrode 31 and the sustain electrode 32 and then exits to the exterior, the image display by the luminescence of corresponding cell can be perceived from the exterior.

In the image display process, the brightness characteristic and the luminescence efficiency are determined according to the amount of the visible rays exited to the exterior, and the exit amount of the visible rays is determined by various factors.

Particularly, in the condition that other factors including the luminescence characteristic of the phosphor are the same, the exit amount of the visible rays is determined by the aperture rate of the cell, i.e., the spaced distance between the scan electrode 31 and the sustain electrode 32. Since the transparent electrodes 31*a* and 32*a* slightly affects, it can be said that the exit amount of the visible rays is determined by the spaced distance r between the opaque electrodes 31*b* and 32*b*, and the greater the spaced distance, the more improved the brightness characteristic and luminescence efficiency.

In the panel structure of the conventional technique as described above and the accompanying driving method, the cells are divided in a column direction by the paired row electrodes, i.e., the paired scan electrode 31 and sustain electrode 32, and for the sustain of the luminescence, it is necessary to generate a sustain discharge between a pair of row electrodes 30 arranged in corresponding cell.

Hence, the spaced distance r between the opaque electrodes 31*b* and 32*b* is limited by the maximum distance between the scan electrode 31 and the sustain electrode 32 arranged in each cell, and this causes a problem that the range to improve the brightness characteristic and luminescence efficiency is limited even though the spaced distance r between the adjacent opaque electrodes 31*b* and 32*b* is made great.

SUMMARY OF THE INVENTION

Accordingly, an object of the present invention is to provide an improved PDP in which the cell is divided in a column direction by one row electrode and corresponding row electrode is concerned in the discharge of two adjacent cells and a driving method thereof, thereby increasing the spaced distance between the opaque electrodes, i.e., the aperture rate of the cell to enhance the brightness characteristic and luminescence efficiency, and reducing the number of required row electrodes to simplify the structure of the panel.

To achieve the above object of the present invention, there is provided a plasma display panel in which a plurality of row electrodes are arranged to be crossed with a plurality of column electrodes between two substrates which are combined in parallel.

In such a PDP, the row electrode has a transparent electrode with a plurality of projecting electrode parts which are alternately projected upward and downward with a predetermined width along a row axis and an opaque electrode formed at the lower part of the row axis of the transparent electrode. The column electrode is arranged on a column axis of the projecting electrode part and the row electrode is concerned in the discharge of two column-direction cell groups by the interaction with two other row electrodes adjacent in a column direction.

Preferably, the predetermined width is the width of a unit cell.

Preferably, two row electrodes adjacent in a column direction are formed to be in parallel in a column direction by the projecting electrode parts spaced by a predetermined distance.

Selectively, the opaque electrode is injected with a predetermined width at the position and direction where the projecting electrode part is arranged.

Selectively, the opaque electrode is projected with a predetermined width at the position and from the inverse direction where the projecting electrode part is arranged.

The method for driving the plasma display panel in which a plurality of row electrodes are arranged to be crossed with a plurality of column electrodes between two substrates in a plurality of cells, and the row electrode is concerned in the discharge of two adjacent row-direction cell groups by the interaction with two other row electrodes adjacent in a column direction, comprises the steps of applying a scan voltage between the column electrode and row electrode corresponding to a discharge cell, thus generating an address discharge between corresponding column and row electrodes, applying a sustain voltage to the row electrode, thus generating a sustain discharge between the row electrode and other row electrode adjacent to the row electrode, applying the sustain voltage to the other row electrode, thus generating the sustain discharge again between the row electrode and the other row electrode.

Preferably, the discharge start voltage of the discharge cell is higher than the addition of a wall voltage by the address discharge to the scan voltage applied to the adjacent cell.

Preferably, the discharge start voltage of the discharge cell is lower than the addition of a wall voltage by the address discharge to the sustain voltage applied to the adjacent row electrode.

BRIEF DESCRIPTION OF THE DRAWINGS

The foregoing and other objects, features and advantages of the present invention will become more apparent from the following detailed description when taken in conjunction with the accompanying drawings in which.

DETAILED DESCRIPTION OF THE PREFERRED EMBODIMENT

Figure 1:
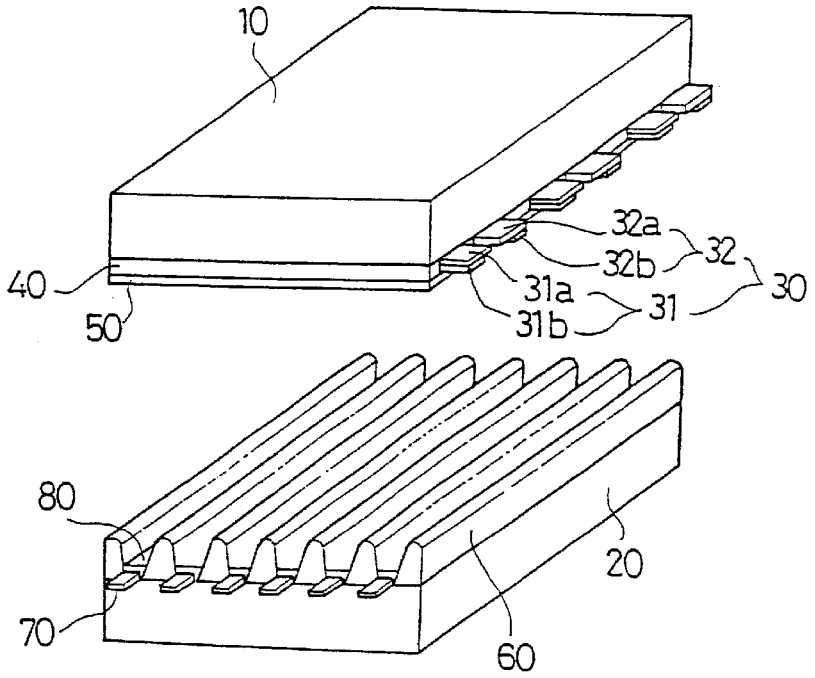
Fig. 1 RELATED ART
FIG. 1 is a separated perspective view showing the upper and lower substrates of a conventional plasma display panel.

The present invention will be described in detail with reference to the accompanying drawings.

Throughout the drawings, it is noted that the same reference numerals of letter will be used to designate like or equivalent elements and a repeated description will be omitted for clarity.

Figure 6:
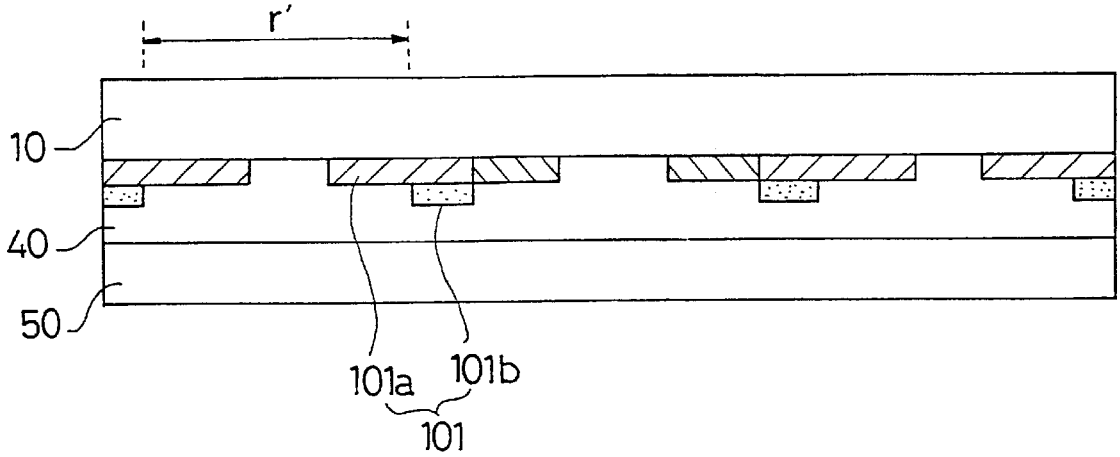
FIG. 6 is a partial cross sectional view showing the upper substrate of the PDP according to a preferred embodiment of the present invention.
Figure 7:
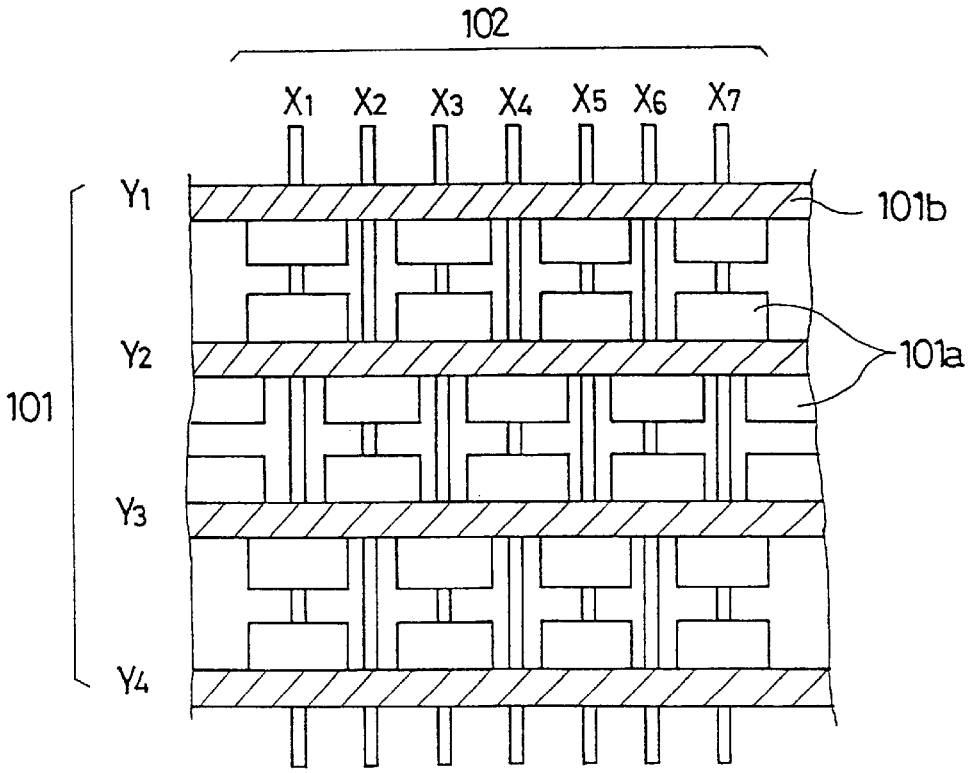
FIG. 7 is a view showing an arrangement of the electrodes in the PDP having the upper substrate of FIG. 6.

FIG. 6 is a partial cross sectional view showing an upper substrate of a PDP according to a preferred embodiment of the present invention, and FIG. 7 is a view showing an arrangement of the electrodes.

Referring to the PDP of the present invention, each of a plurality of row electrodes 101 (Y1, Y2, Y3, . . . ) has a transparent electrode 101*a* made of ITO with a plurality of projecting electrode parts alternately projected upward and downward with a predetermined width, i.e., a unit cell width along a row axis and an opaque electrode 101*b* made of metal formed below the row axis of the transparent electrode 101*a*. The row electrodes are formed at the surface of the upper substrate 10 facing the lower substrate 20 to be arranged in parallel in a column direction with the projecting electrode parts of adjacent row electrodes (Y1 and Y2, Y2 and Y3, Y3 and Y4, . . . ) being spaced by a predetermined distance, thus dividing the cells in a column direction. The column electrodes are formed at the surface of the lower substrate 20 facing the upper substrate 10 to be arranged on a column axis of the projecting electrode parts, with being crossed with the row electrodes 101, thus dividing the cells in a row direction.

Figure 8:
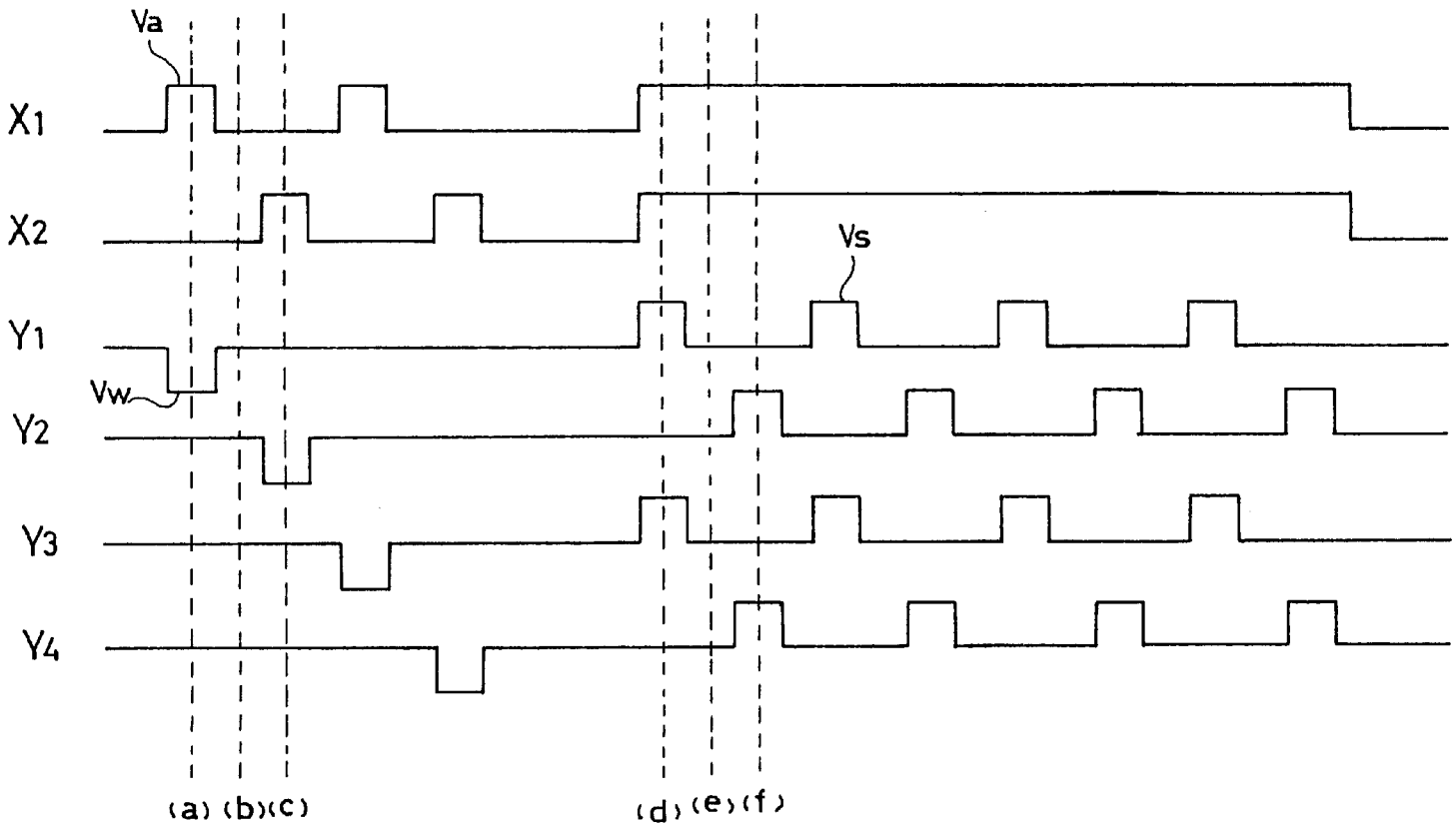
FIG. 8 is a view showing the driving wave forms applied to each electrode according to the present invention.

In the PDP structured as described above, a row electrode Y2 is concerned in the discharge of two column-direction cell groups adjacent in a column direction by the interaction with two other row electrodes Y1 and Y3 adjacent in a column direction. In such a discharge process, if the driving wave forms shown in FIG. 8 are applied to each electrode 101, 102, the processing states of the wall charge in the sections (a) to (f) can be shown as the states (a) to (f) of FIG. 9.

Before the section (a) of FIG. 7, there is no wall charge in the discharge cell. If an address pulse Va and a write pulse Vw are applied to the column electrode X1 and the row electrode Y1 in the section (a) of FIG. 7, there occurs an address discharge between the column and row electrodes X1 and Y1. After such an address discharge, the wall charge is formed in the cell in the section (b).

In this case, most of the wall charge is formed at the row electrode Y1 and the other row electrode Y2 adjacent to the row electrode Y1. That is, (+) wall charge is formed at the row electrode Y1 and (−) wall charge is formed at the row electrode Y2.

If the address pulse Va and the write pulse Vw are applied in the section (c) to the column electrode X2 and the row electrode Y2 in the state in which the wall charge is formed as described above, there occurs an address discharge between two electrodes X2 and Y2. After this address discharge, the wall charge is formed in corresponding cell.

Here, the cell adjacent in a column direction, i.e., the cell where the column electrode X1 is crossed with the row electrodes Y1 and Y2 should not be affected by the scan voltage (Va +Vw) applied to the column electrode X2 and the row electrode Y2.

Figure 9:
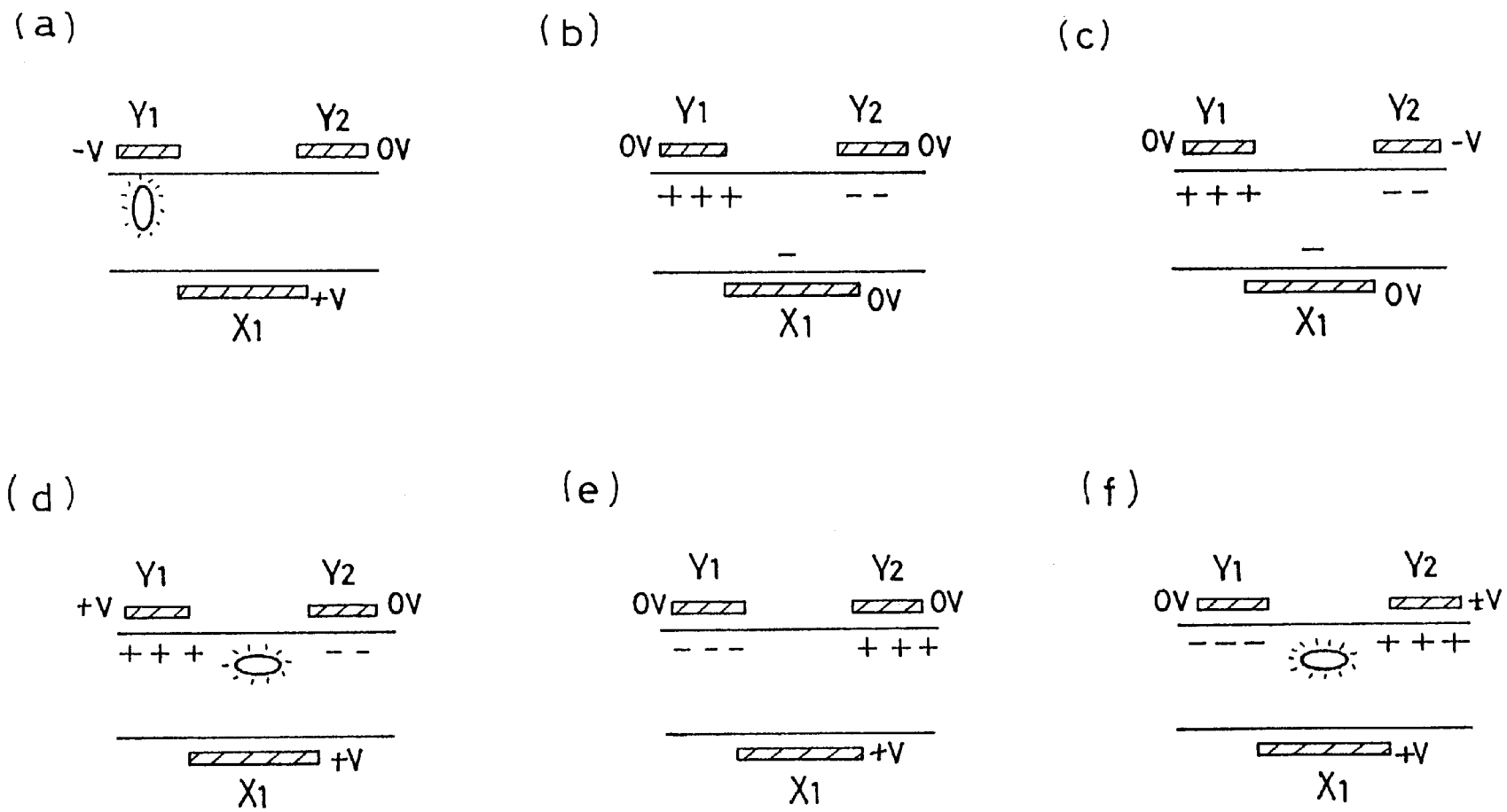
FIG. 9 is a view showing the processing states of the wall charge of corresponding cell according to the driving wave forms of FIG. 8.
Figure 10:
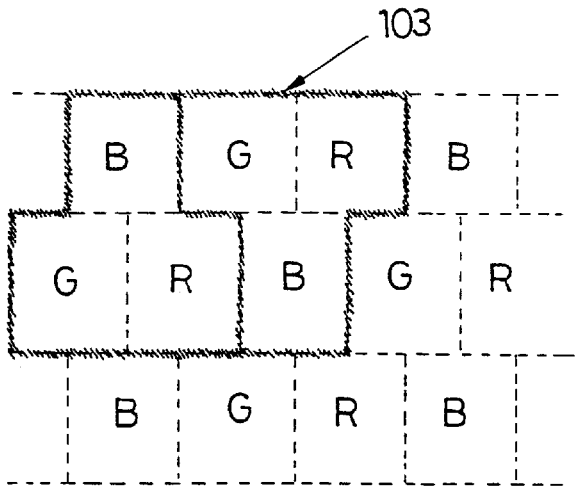
FIG. 10 is a view showing the arrangement of the phosphor doped inside of each cell according to the present invention.

Hence, the voltage obtained by adding the wall voltage by the wall charge to the scan voltage (Va +Vw) applied to adjacent cell is adjusted to be lower than a discharge start voltage of corresponding cell, and thereby the cell where the column electrode X1 is crossed with the row electrodes Y1 and Y2 sustains the wall charge like the state (c) of FIG. 9.

If the sustain pulse Vs is applied to the row electrodes Y1 and Y2 in the section (d), the voltage obtained by adding the sustain voltage Vs on the both ends of the row electrodes Y1 and Y2 to the wall voltage becomes higher than the discharge start voltage, thus causing the sustain discharge between the row electrodes Y1 and Y2. After the first sustain discharge, the wall charge opposite to that at the section (c) is formed at the section (e).

Next, if the sustain pulse Vs is applied to the row electrodes Y2 and Y4 at the section (f), the voltage obtained by adding the sustain voltage Vs on the both ends of the row electrodes Y1 and Y2 to the wall voltage becomes higher than the discharge start voltage, thus causing the sustain discharge between the row electrodes Y1 and Y2 again. Thereafter, there forms a wall charge opposite to that at the section (e).

Figure 2:
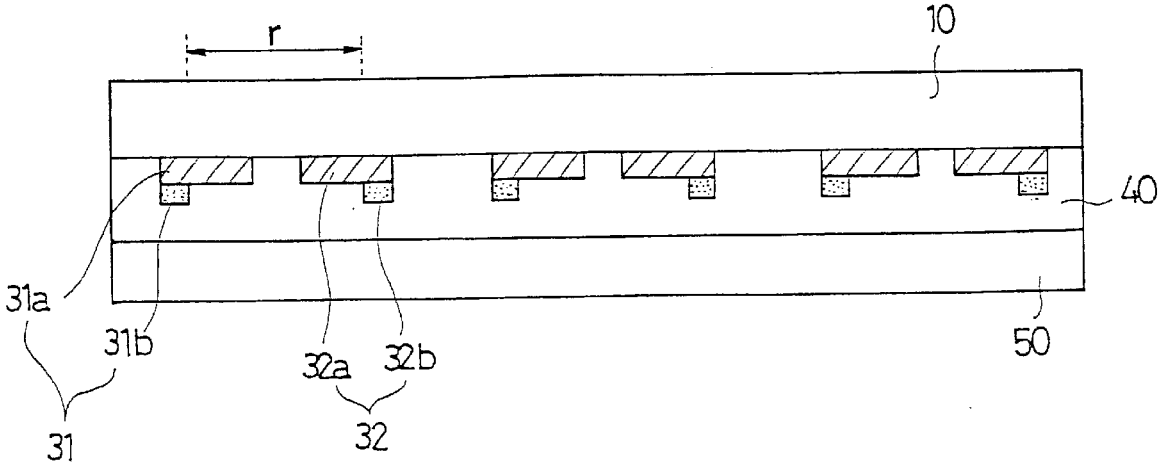
Fig. 2 RELATED ART
FIG. 2 is a partial cross sectional view showing the upper substrate of FIG. 1.
Figure 3:
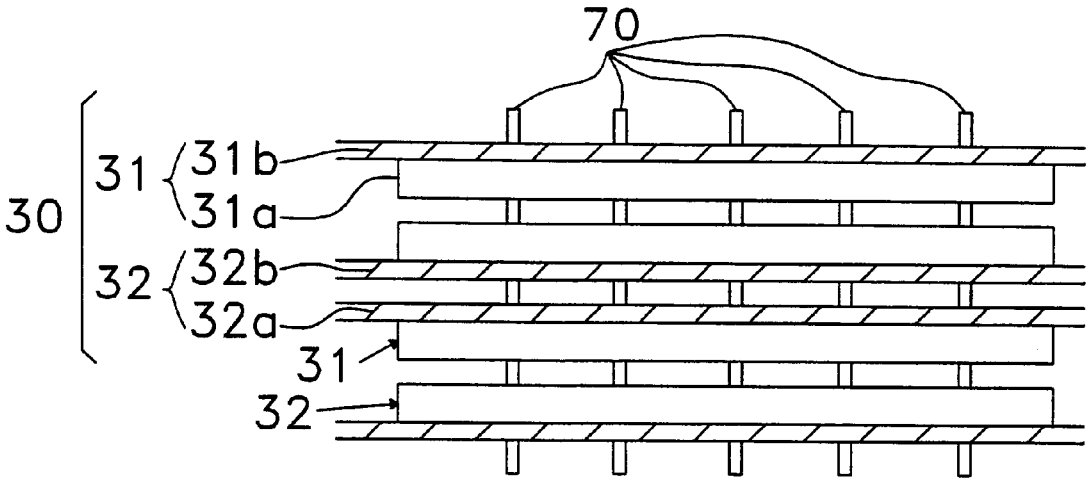
FIG. 3 RELATED ART
FIG. 3 is a view showing the arrangement of the PDP according to a prior art.
Figure 4:
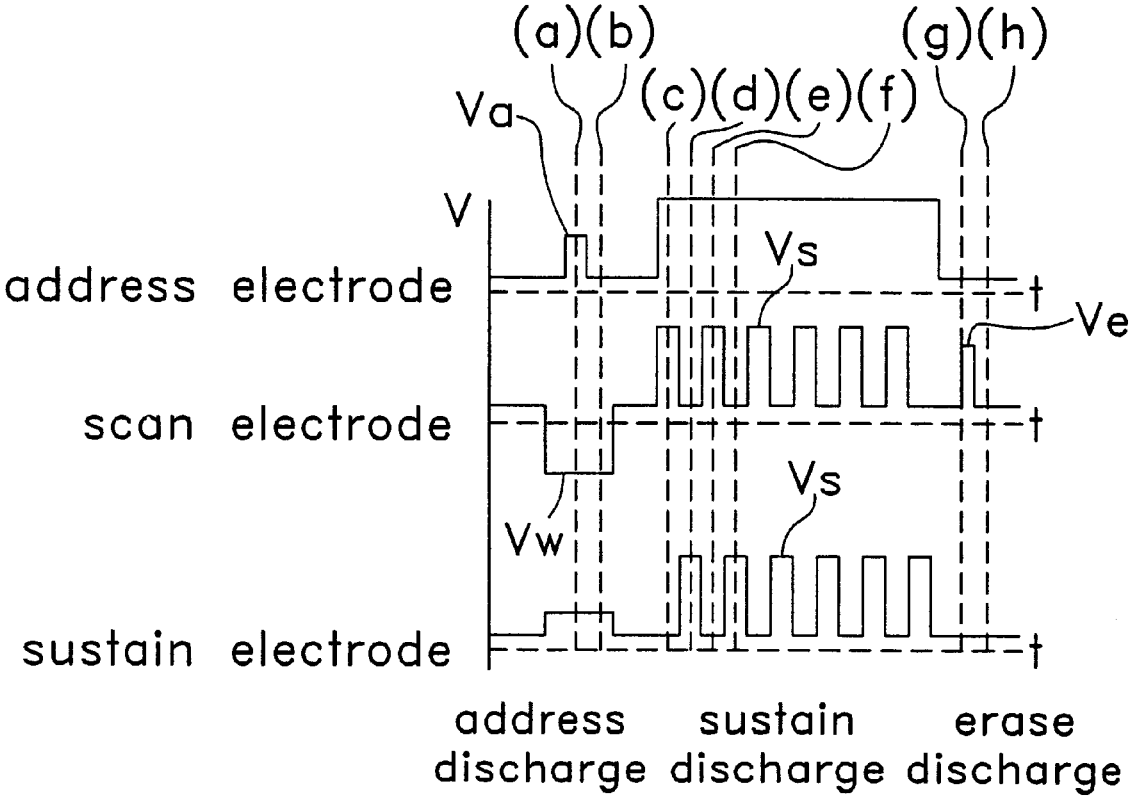
FIG. 4 RELATED ART
FIG. 4 is a view showing the driving wave forms applied to each electrode according to a prior art.
Figure 5:
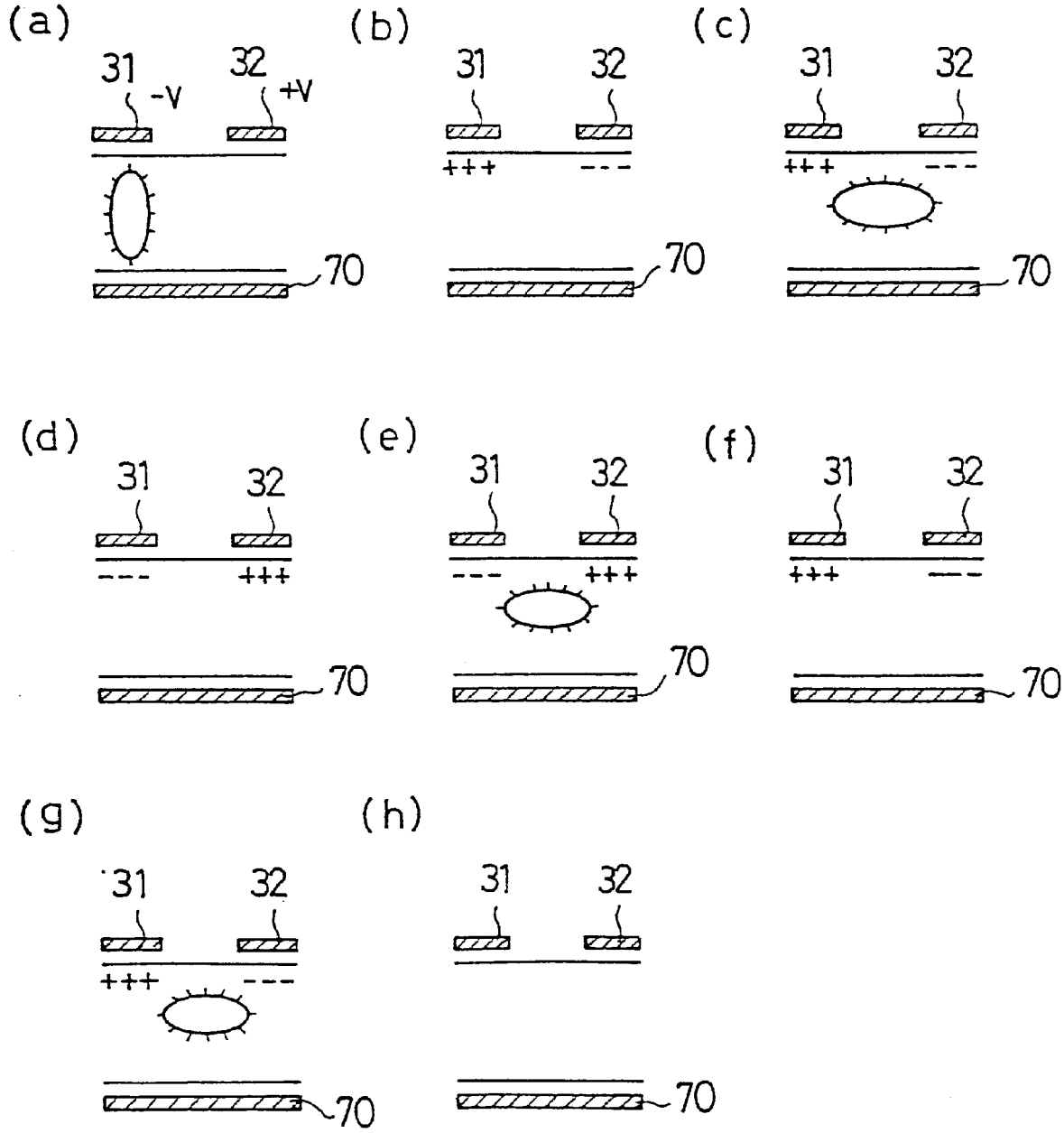
Fig. 5 RELATED ART
FIG. 5 is a view showing the processing states of the wall charge of corresponding cell according to the driving wave forms of FIG. 4.

Comparing the PDP of FIG. 2 with the PDP of FIG. 6, the row electrodes are arranged at the center of the unit cell in the prior art, while the row electrodes are arranged at both edges of the unit cell, i.e., at the boundary surface of the cell in the present invention.

Hence, from the characteristic in structure, the spaced distance r' between adjacent opaque electrodes of the unit cell according to the present invention is slightly affected as compared with the prior art. That is, as can be seen from FIGS. 2 and 6, the spaced distance r', i.e., the aperture rate becomes large compared with the spaced distance r of the prior art, and thus the exit amount of the visible ray is also increased, enhancing the brightness characteristic and luminescence efficiency.

Further, in doping the red (R), green (G) and blue (B) phosphor inside of each cell, it is preferred that the phosphor of the same color is not adjacent by making each unit pixel 103 constitute a triangle structure.

In the meanwhile, the PDP structured as described above can be varied to other embodiments within the scope of basic form. For example, FIG. 11 is a view showing the arrangement of the electrodes of PDP according to another preferred embodiment of the present invention.

Figure 11:
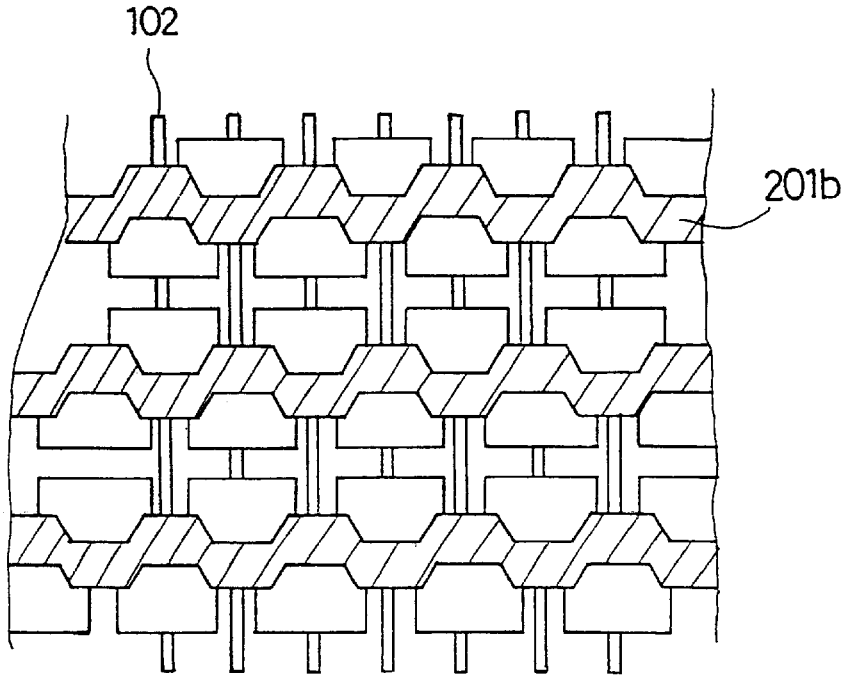
FIG. 11 is a view showing an arrangement of the electrodes in the PDP according to another preferred embodiment of the present invention.

The PDP of FIG. 11 is differ from that of FIG. 7 in that the form of the opaque electrodes is varied. In FIG. 11, the opaque electrode 201*b* is injected with a predetermined width at the position and direction where the projecting electrode parts are arranged and is projected with a predetermined width from the opposite direction thereof.

Then, the space distance between adjacent opaque electrodes 201*b*, i.e., the aperture rate of a unit cell is increased by the injected part, thus enhancing the brightness characteristic and luminescence efficiency. And since the width of the opaque electrode 201 is constantly sustained by the projected part, its own resistance is equally sustained.

As described above, the present invention can enhance the brightness characteristic and luminescence efficiency even though the aperture rate of a unit cell is increased and also can simplify the panel structure by the drastic reduction in the number of required row electrodes.

While this invention has been described in connection with what is presently considered to be the most practical and preferred embodiment, it is to be understood that the invention is not limited to the disclosed embodiment, but, on the contrary, it is intended to cover various modifications within the spirit and scope of the appended claims.

What is claimed is:

1. A plasma display panel in which a plurality of cells are constituted by a plurality of row and column electrodes which are directly crossed with one another between two substrates which are combined in parallel, characterized in that said row electrode has a transparent electrode having a plurality of projecting electrode parts which are alternately projected upward and downward with a predetermined width along a row axis, and an opaque electrode formed at the lower portion of the row axis of said transparent electrode, said column electrode is arranged on a column axis of said projecting electrode part, and said row electrode is concerned in the discharge of two adjacent column-direction cell groups by the interaction with two other row electrodes adjacent in a column direction.

2. The plasma display panel as claimed in claim 1, wherein said predetermined width is the width of a unit cell.

3. The plasma display panel as claimed in claim 1, wherein two row electrodes adjacent in a column direction are formed to be in parallel in a column direction with said projecting electrode parts being distanced by a predetermined distance.

4. The plasma display panel as claimed in claim 1, wherein said opaque electrode is injected with a predetermined width at the position and direction where said projecting electrode parts are arranged.

5. The plasma display panel as claimed in claim 4, wherein said opaque electrode is projected with a predetermined width at the position and from an opposite direction where said projecting electrode parts are arranged.

6. A method for driving a plasma display panel in which a plurality of cells are constituted by a plurality of row and column electrodes which are arranged to be directly crossed with one another between two substrates which are combined in parallel, and said row electrode is concerned in the discharge of two adjacent column-direction cell groups by the interaction with two other row electrodes adjacent in a column direction, comprising the steps of:

applying a scan voltage between said column electrode and row electrode corresponding to a discharge cell, thus generating an address discharge between corresponding column and row electrodes;

applying a sustain voltage to said row electrode, thus generating a sustain discharge between said row electrode and other row electrode adjacent to said row electrode; and applying said sustain voltage to said other row electrode, thus generating said sustain discharge again between said row electrode and said other row electrode.

7. The method as claimed in claim 6, wherein a discharge start voltage of said discharge cell is higher than the addition of a wall voltage by said address discharge to said scan voltage applied to the adjacent cell.

8. The method as claimed in claim 6, wherein a discharge start voltage of said discharge cell is lower than the addition of a wall voltage by said address discharge to said sustain voltage applied to the adjacent row electrode.

* * * * *